US008210538B2

(12) United States Patent
Shoemaker, Jr.

(10) Patent No.: US 8,210,538 B2
(45) Date of Patent: Jul. 3, 2012

(54) PLASTIC CAPSULE FOR CRANE GAME

(76) Inventor: Stephen P. Shoemaker, Jr., Redondo Beach, CA (US)

( * ) Notice: Subject to any disclaimer, the term of this patent is extended or adjusted under 35 U.S.C. 154(b) by 194 days.

(21) Appl. No.: 12/686,944

(22) Filed: Jan. 13, 2010

(65) Prior Publication Data

US 2011/0169218 A1 Jul. 14, 2011

(51) Int. Cl.
*A63F 9/30* (2006.01)

(52) U.S. Cl. ..... 273/288; 273/148 R; 273/447; 273/454

(58) Field of Classification Search ..... 273/288, 273/290, 138.1, 138.2, 148 R, 440, 447, 454
See application file for complete search history.

(56) References Cited

U.S. PATENT DOCUMENTS

| | | | | |
|---|---|---|---|---|
| 2,858,955 | A * | 11/1958 | Kroenert | 220/4.21 |
| 2,899,097 | A * | 8/1959 | Haskins | 220/4.24 |
| 3,292,840 | A * | 12/1966 | Schmidt | 220/4.25 |
| 4,103,774 | A * | 8/1978 | Shingyouchi | 206/45.2 |
| 4,863,054 | A * | 9/1989 | Capetta | 220/4.23 |
| 6,626,313 | B2 * | 9/2003 | Herbstreit et al. | 220/4.25 |
| 6,770,001 | B1 * | 8/2004 | Shoemaker, Jr. | 473/447 |
| 2002/0090879 | A1 * | 7/2002 | Galomb | 446/73 |

* cited by examiner

*Primary Examiner* — Benjamin Layno
(74) *Attorney, Agent, or Firm* — Fulwider Patton LLP

(57) ABSTRACT

A capsule for use in a vacuum crane game is disclosed that is adapted to releasably enclose a prize, the capsule formed by first and second hollow hemispherical elements cooperating to form a plastic sphere when configured in a mating arrangement, at least one of said first and second hollow hemispherical elements including a radially outwardly projecting member substantially circumscribing a first circular edge of said at least one of said first and second hollow hemispherical elements to prevent a vacuum member from engaging the capsule at the radially outwardly projecting member.

3 Claims, 4 Drawing Sheets

PLASTIC CAPSULE FOR CRANE GAME

BACKGROUND

The present invention relates to crane games found in arcades and other places of commerce, and more particularly to a component of a crane game that employs a vacuum mechanism to withdraw prizes wherein the component is a capsule that is particularly suited for vacuum cranes. Capsules are also used in vending machines, merchandise machines or games that use capsules.

Crane games are prevalent in arcades and the like, wherein a player pays for a try to remove a prize from a bin using controls that maneuver a movable crane. The player attempts to withdraw a prize by capturing it with the crane and then depositing it in a pathway that leads out of the prize compartment. One such game is described in U.S. Pat. No. 5,855,374 to the inventor of the present invention, the contents of which are fully incorporated herein by reference, which uses a vacuum pick-up device to capture prizes and deliver them to a chute that leads to the player. Vacuum type crane games offer benefits over traditional claw games as outlined in the '374 patent, but one issue has been the type of prizes that may be used with a vacuum crane. These prizes must typically include a smooth surface so that a proper seal can be established by the vacuum. Plush toys and toys with irregular surfaces, which often made up a bulk of the prizes of traditional crane games, would be excluded by the use of the vacuum crane since the vacuum component cannot form an air-tight seal with prizes of this type and therefore cannot pick them up.

To overcome this problem and allow more types of prizes to be utilized in the vacuum crane game, it is known to use plastic capsules which contain a prize therein. The plastic capsules provide a smooth, hard surface that is easily captured by the vacuum crane, thereby allowing prizes that otherwise would be difficult or impossible to use in such a game to be used. Such capsules are made by assembling two hemispherical halves, such as by snap fit or threads, so that prizes can be inserted into the capsules and easily removed. If the plastic hemispherical halves are transparent the player can determine the contents of the prize, although they may also be opaque to add mystery to the game. However, this solution has raised another drawback that has yet to be addressed in the art. Namely, if a player moves the vacuum onto a crease or discontinuity between the two halves the vacuum may not seal correctly as air from the capsule or adjacent the vacuum port may be sucked into the vacuum port thereby lessening the effective applied pressure. This may cause the player to lose or drop the prize. If the crease or discontinuity is not easily visible this may heighten the frustration of the player because they player does not know why the crane did not successfully pick up the capsule, and may accuse the game of malfunctioning. Moreover, the presence of such an unhindered smooth surface may detract from the skill of the game by rendering it too easy to capture a prize, which can cause disinterest by the player and lead to poor performance by the owner of the game.

SUMMARY OF THE INVENTION

These shortcomings are overcome by the present invention, a capsule for a vacuum crane game that an equatorial ridge or projection that coincides with the hemispherical crease or gap to prevent the vacuum port of the crane from engaging the crease. By preventing the vacuum port from landing on the crease due to the presence of the equatorial ridge, disengagement as a result of air seeping into the vacuum port through the crease is eliminated, enhancing the game and reducing the unintended frustration of the player.

DETAILED DESCRIPTION OF THE PREFERRED EMBODIMENTS

Figure 1:
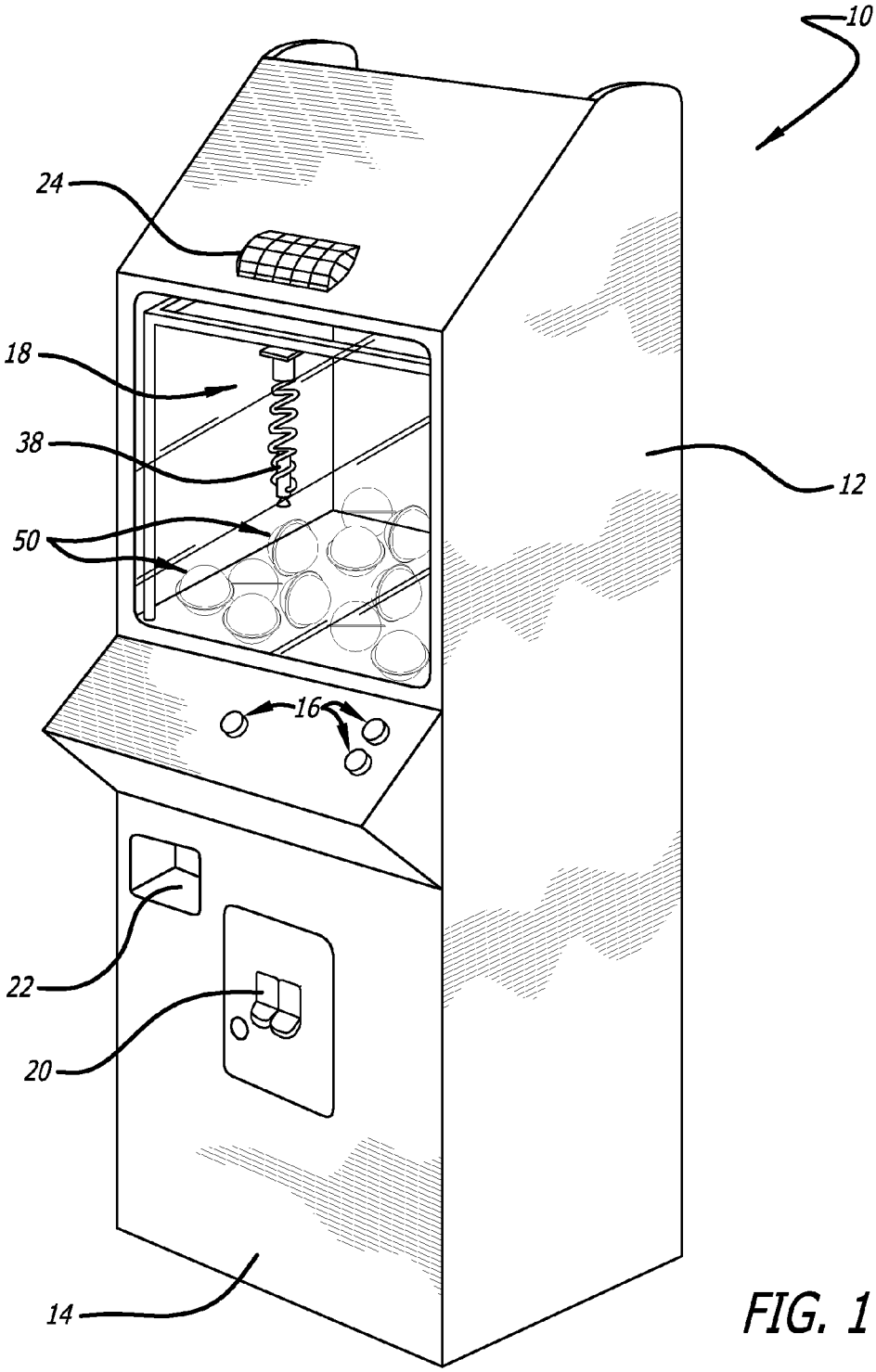
FIG. 1 is an elevated perspective view of a type of vacuum crane game utilized by the present invention.

FIG. 1 is a perspective view of one embodiment of a crane game 10 of the kind used by the present invention. Game 10 includes a housing 12, front panel 14, player controls 16, and a playing area 18. Housing 12 provides a support for the other components of the game apparatus. Housings can take a wide variety of forms; for example, as shown in FIG. 1, housing 12 may be of the stand-up arcade game variety in which a player stands in front of the game or sits on a stool when playing the game. Front panel 14 can be positioned below and/or above the player controls 16 and playing field 18, as shown in FIG. 1. The front panel can also be positioned in a wide variety of other locations on housing 12. Front panel 14 includes a coin deposit slot 20, dispenser 22, and speaker 24.

Coin deposit slot 20 typically accepts standard currency coins, game tokens, or bills that are often available in an arcade environment. In some embodiments, other types of monetary input may also be provided, such as a credit card, debit card, etc. A coin deposited in coin deposit slot 20 starts a game. Dispenser 22 is used to provide prizes to the player which have been won by the player from playing the game. Dispenser 22 guides a prize from playing area 18 to a player-accessible door and/or aperture from which the player retrieves the prize. Speaker(s) 24 emits sounds based on game actions and other game states and is controlled by a game control system as described subsequently. The front panel 14 can also include other features if appropriate. For example, in an alternative embodiment, a ticket dispenser (not shown) may be included on front panel 14 if desired to dispense a ticket award to the player based upon a game score, characteristics of a captured object, or other result or event of a game, rather than (or in addition to) providing the player with a prize in dispenser 22.

Player controls 16 allow a player to manipulate events in the game, and typically include a joystick, buttons, switch, knob, or the like. Game action occurs in playing area 18, where a vacuum pick up mechanism may be controlled and guided by the player to pick up prize objects, as described below. The vacuum crane 38 is manipulated by the player to move the pick up device in two directions along an axis (or additional directions, in alternate embodiments). Buttons 16 can also be provided to select various game functions, such as additional directional control of the pick up device, number of players in a game, a start button to begin the game, etc. In some embodiments, a player may get multiple chances to guide the pick up mechanism with one coin or credit, or, alternatively, the player may be required to insert additional coins.

Game playing area 18 is used to display the game action and prizes to a player and is the area where game action occurs. A transparent shield can prevent the player from interfering with game action. The playing area 18 houses a prize display area along with a vacuum pick up device 38 and a chute for collecting a prize once captured. The player guides the head of the pick up device 38 and lowers the head so that a prize may be picked up. If a prize is picked up, the game controller automatically guides the pick up head above the chute, drops the prize into the chute where it may be retrieved by the player, and moves back into a starting position.

Figure 2:
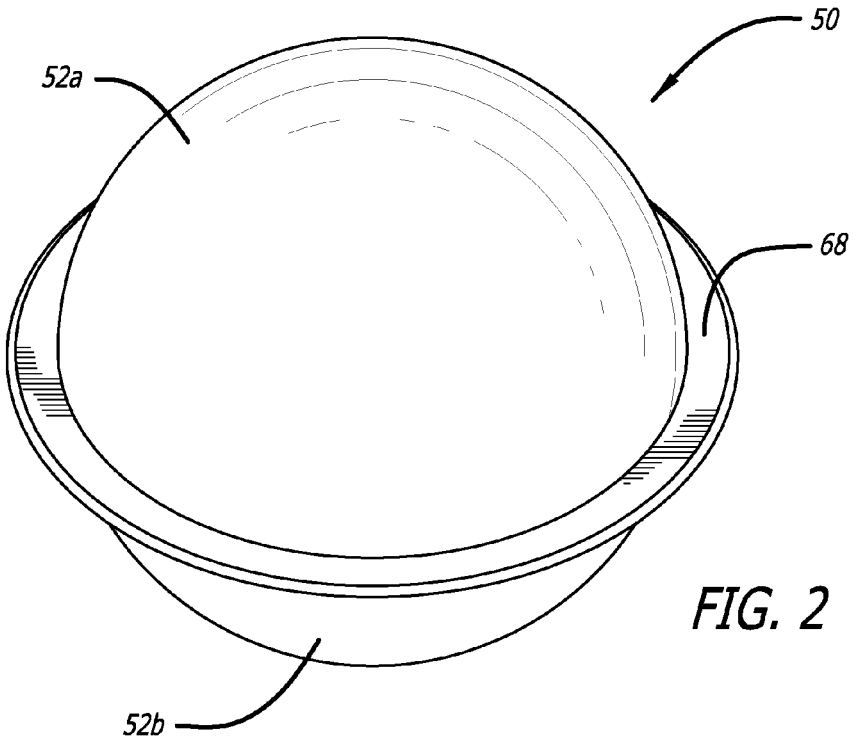
FIG. 2 is an enlarged, elevated perspective view of an embodiment of a capsule of the present invention.
Figure 3:
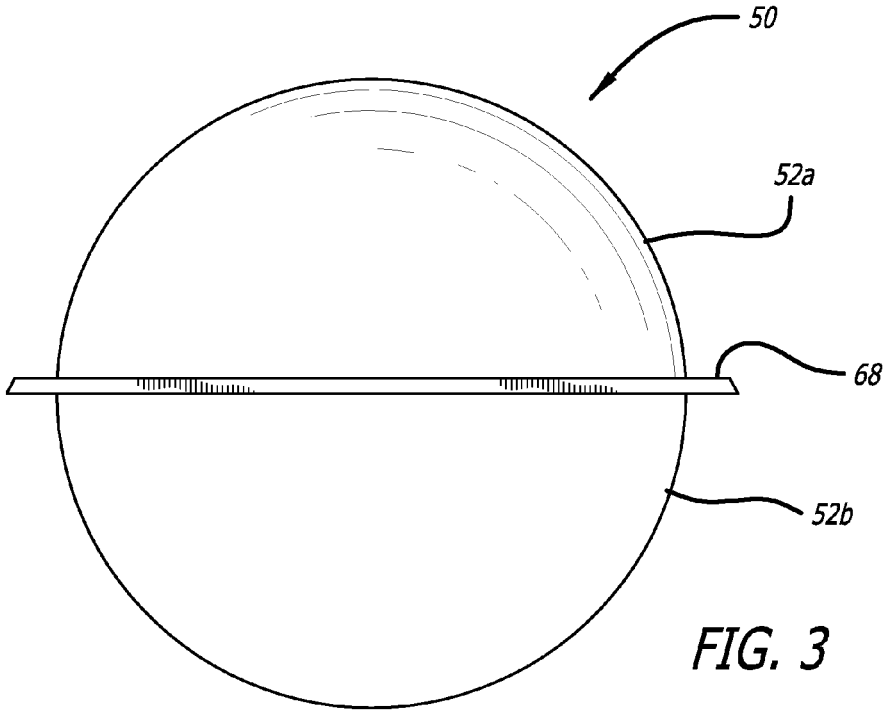
FIG. 3 is an enlarged, side view of the embodiment of FIG. 2.

The playing area is filled with plastic capsules 50 as shown in FIGS. 2 and 3, wherein the plastic capsules are preferably transparent to reveal the contents therein. The contents can be candy, toys, bubble gum cards, coupons, or any number of assorted prizes that would interest a player of the game. The capsule 50 is formed by a pair of hemispherical elements 52*a,b* cooperating to form a plastic transparent sphere that can be opened and closed by releasing and engaging the two hemispherical halves. At least one of said first and second hollow hemispherical elements 52*a,b* includes a radially outwardly projecting member 68 substantially circumscribing a first circular edge 70 of said at least one of said first and second hollow hemispherical elements 52*a,b*. The radially outwardly projecting member 68 can be continuous around the equator of the sphere when assembled or can be discontinuous, but there should be no gaps or discontinuities of a dimension that would allow a vacuum port 38 to engage the capsule 50 at said gap or discontinuity. This prevents a vacuum port 38 from engaging the capsule at a crease 72 or seal between the two hemispherical elements 52*a,b*, where air can seep through or around the attachment of the vacuum with the surface of the capsule 50.

Figure 6:
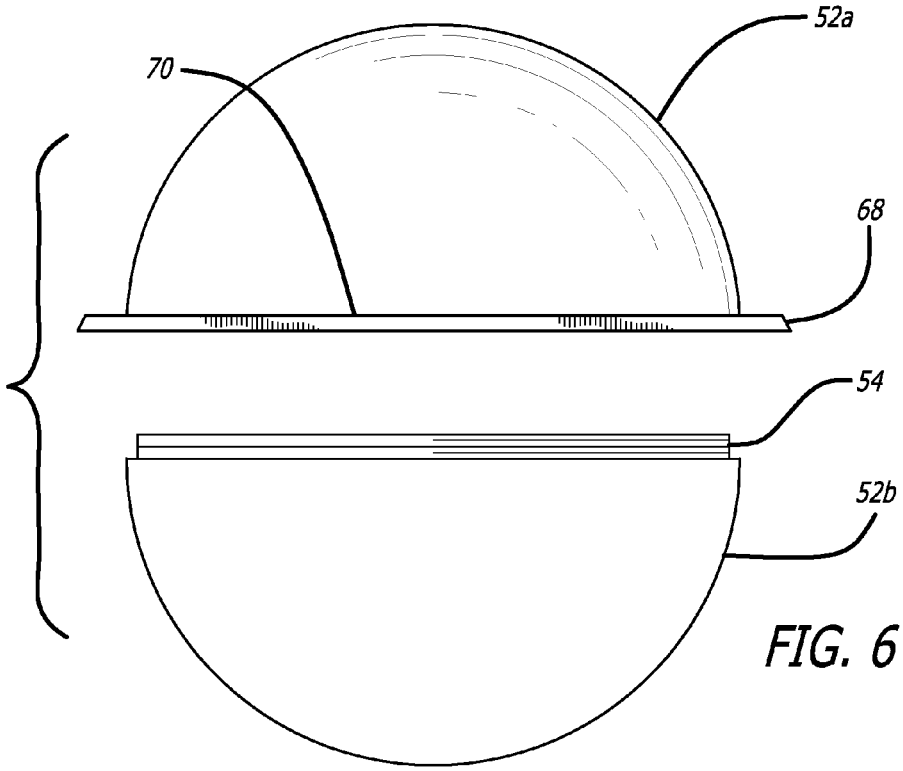
FIG. 6 is a side view of the capsule separated into two hemispherical elements.
Figure 7:
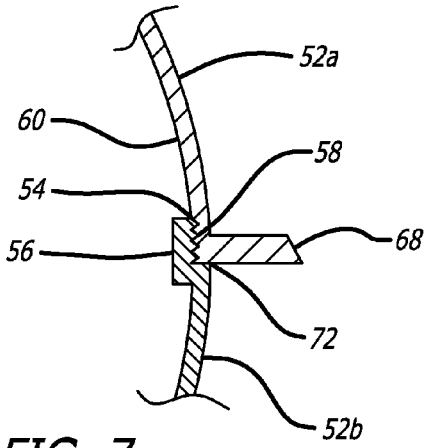
FIG. 7 is an enlarged, sectional view of the mating of an upper half of the capsule with a lower half using a threaded engagement.
Figure 8:
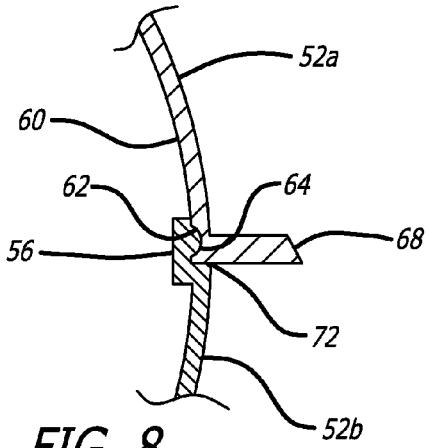
FIG. 8 is an enlarged, sectional view of the mating of an upper half of the capsule with a lower half using a press fit engagement.
Figure 9:
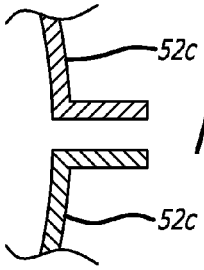
FIG. 9 is an enlarged, cross-sectional view of a preferred embodiment of the present invention and the juncture of the two halves.

As shown in FIGS. 6-8, the two halves 52*a,b* can be formed together mechanically by a threaded engagement or a snap-fit engagement, although other types of mechanical engagement can be utilized to form a mating arrangement. When a threaded engagement is used, outer threads 54 on a collar 56 of the lower half 52*b* engage inner threads 58 along an inner surface 60 on the upper half 52*a* to cooperate to mechanically engage the two halves. Alternatively, a detent 62 along the collar 56 of the lower half 52*b* snaps into a recess 64 along the inner surface 60 of the upper half 52*a*. Other types of mechanical attachments are also envisioned for the present invention, including but not limited to adhesive, clips, fasteners, tape, and the like. Or more preferably, as shown in FIG. 9, two identical halves 52*c* similar to half 52*a* can be mated together with heat, ultrasonic bonding, or adhesive. Using identical halves simplifies the molding task and limits the inventory to one type, making it a preferred embodiment. The two outwardly projecting members can be sealed at discrete locations (spot welding) or all around the perimeter using a heat press to completely seal the compartment. The construction of the capsule results in a more sturdy package that won't open when pressed or collapsed.

Conventional clear plastic capsules used for holding toys in vending machines and the like are hard and brittle, and expensive to manufacture. They also do not stack well and inventory takes up large amounts of space. The present invention is preferably formed from vacuum-forming a clear, soft plastic material that results in capsules that do not crack or splinter when opened or compressed. They also stack exceedingly well and are inexpensive to manufacture, and can be manufactured by a machine rather than by hand.

Figure 4:
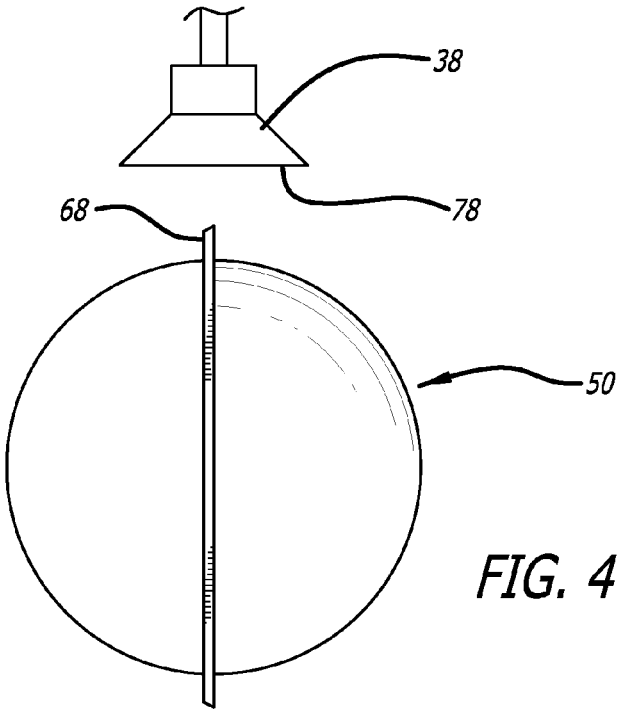
FIG. 4 is a side view of a vacuum device attempting to pick up the embodiment of FIG. 2.
Figure 5:
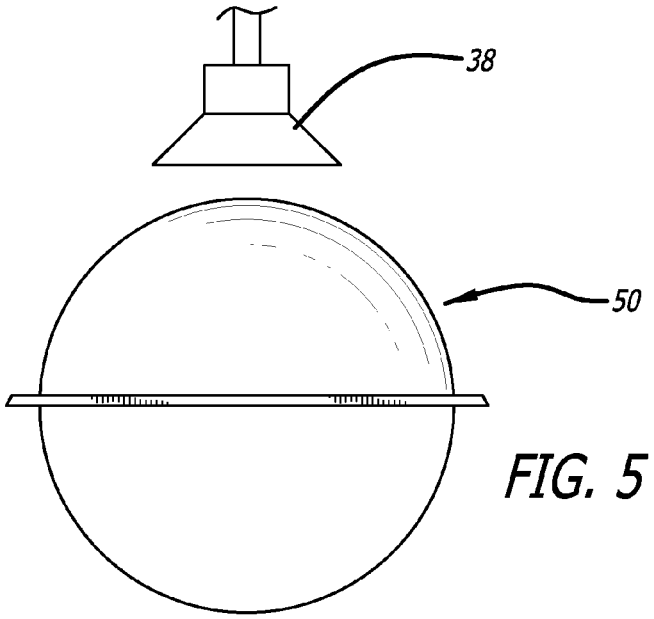
FIG. 5 is a side view of a vacuum device attempting to pick up the embodiment of FIG. 2 in a different orientation.

As shown in FIGS. 4 and 5, the vacuum port 38 cannot form a seal with the capsule 50 when the outwardly projecting member 68 lies below the mouth 78 of the suction device. This would be readily apparent to the player, and the player would be discouraged from selecting this particular prize. This adds to the challenge of the game, and addresses the problem where a player successfully attaches the vacuum device to a capsule, only to have the capsule drop because the vacuum device is disposed on the crease between the two halves of the capsule and air from the capsule passes through the seal to compromise the suction of the device. Conversely, when the vacuum device 38 attaches to a capsule as shown in FIG. 5 there is no opportunity for the above-described problem to occur and the player is ensured an air-tight seal with the capsule.

The above-described embodiments are mere examples of the types of embodiments reflected by the present invention, and are not intended to be limited. Rather, the full scope of the invention is to be determined from the words of the claims herein, using the words plain and ordinary meanings.

I claim:

1. A capsule for use in a vacuum crane game adapted to releasably enclose a prize comprising:

first and second hollow hemispherical elements cooperating to form a plastic sphere when configured in a mating arrangement, at least one of said first and second hollow hemispherical elements including a radially outwardly projecting member substantially circumscribing a first circular edge of said at least one of said first and second hollow hemispherical elements, the radially outwardly projecting member having a distal edge that forms an acute angle with a lower surface; and wherein the first hollow hemispherical element includes a collar that is radially inwardly offset from the second hemispherical element, the collar including a radially outwardly formed detent that cooperates with a mating recess on an inner surface of the second hollow hemispherical element to couple the first and second elements.

2. The capsule of claim 1 wherein the radially outwardly projecting member is flexible.

3. The capsule of claim 1 wherein the first and second hemispherical halves are made of a vacuum-forming process.

* * * * *